US010470248B2

(12) United States Patent
Ooyama et al.

(10) Patent No.: US 10,470,248 B2
(45) Date of Patent: Nov. 5, 2019

(54) DIRECT RESISTANCE HEATING METHOD

(71) Applicant: NETUREN CO., LTD., Shinagawa-ku, Tokyo (JP)

(72) Inventors: Hironori Ooyama, Tokyo (JP); Kunihiro Kobayashi, Tokyo (JP)

(73) Assignee: NETUREN CO., LTD., Tokyo (JP)

( * ) Notice: Subject to any disclaimer, the term of this patent is extended or adjusted under 35 U.S.C. 154(b) by 913 days.

(21) Appl. No.: 14/419,509

(22) PCT Filed: Aug. 6, 2013

(86) PCT No.: PCT/JP2013/071749
§ 371 (c)(1),
(2) Date: Feb. 4, 2015

(87) PCT Pub. No.: WO2014/025054
PCT Pub. Date: Feb. 13, 2014

(65) Prior Publication Data

US 2015/0208466 A1 Jul. 23, 2015

(30) Foreign Application Priority Data

Aug. 6, 2012 (JP) ..... 2012-174464

(51) Int. Cl.
*H05B 3/00* (2006.01)
*C21D 9/00* (2006.01)
(Continued)

(52) U.S. Cl.
CPC ..... *H05B 3/0004* (2013.01); *C21D 1/40* (2013.01); *C21D 9/0012* (2013.01); *C21D 9/50* (2013.01);
(Continued)

(58) Field of Classification Search
CPC ..... C21D 1/40; C21D 1/673; C21D 9/0012; C21D 9/0068; C21D 9/46; C21D 9/50;
(Continued)

(56) References Cited

U.S. PATENT DOCUMENTS 5,571,431 A * 11/1996 Lantieri ..... B23K 9/0953 219/130.01
5,676,862 A * 10/1997 Matteson ..... B23K 11/063 219/110
(Continued)

FOREIGN PATENT DOCUMENTS

JP 61-037922 2/1986
JP 61-37922 2/1986
(Continued)

OTHER PUBLICATIONS

Translation JP 2111817.*
(Continued)

*Primary Examiner* — Ibrahime A Abraham
*Assistant Examiner* — Frederick F Calvetti
(74) *Attorney, Agent, or Firm* — Wenderoth, Lind & Ponack, L.L.P.

(57) ABSTRACT

A direct resistance heating method includes placing a first electrode and a second electrode such that a space is provided between the first electrode and the second electrode and such that each of the first electrode and the second electrode extends across a heating target region of a workpiece, moving at least one of the first electrode and the second electrode with an electric current being applied between the first electrode and the second electrode, and adjusting a time during which the electric current is applied for each segment region of the heating target region, the segment regions being defined by dividing the heating target region and are arranged side by side along a direction in
(Continued)

which the at least one of the first electrode and the second electrode is moved.

10 Claims, 10 Drawing Sheets

(51) Int. Cl.

| | |
|---|---|
| ***C21D 9/50*** | (2006.01) |
| ***C21D 1/40*** | (2006.01) |
| ***H05B 3/02*** | (2006.01) |
| ***H05B 3/03*** | (2006.01) |
| *C21D 9/46* | (2006.01) |
| *C21D 1/673* | (2006.01) |

(52) U.S. Cl.
CPC ..... *H05B 3/0023* (2013.01); *H05B 3/023* (2013.01); *H05B 3/03* (2013.01); *C21D 1/673* (2013.01); *C21D 9/0068* (2013.01); *C21D 9/46* (2013.01)

(58) Field of Classification Search
CPC ..... C21D 9/48; H05B 3/0004; H05B 3/0023; H05B 3/023; H05B 3/03; H05B 3/004
USPC ..... 219/240, 476, 482, 50, 117.1; 148/526
See application file for complete search history.

(56) References Cited

U.S. PATENT DOCUMENTS

| | | | | |
|---|---|---|---|---|
| 7,714,253 | B2 * | 5/2010 | Machrowicz | H05B 3/0014 219/162 |
| 7,838,791 | B2 * | 11/2010 | Nagashima | B29B 17/02 219/69.11 |
| 9,907,118 | B2 * | 2/2018 | Ooyama | H05B 3/03 |
| 2003/0217991 | A1 * | 11/2003 | Gomez | C21D 1/40 219/50 |
| 2005/0224467 | A1 * | 10/2005 | Val | B23K 11/067 219/83 |
| 2008/0210667 | A1 * | 9/2008 | Yang | H01L 21/268 219/121.6 |
| 2010/0269559 | A1 * | 10/2010 | Ishiguro | C21D 1/673 72/342.1 |
| 2010/0285328 | A1 * | 11/2010 | Nonomura | B21D 22/02 428/600 |
| 2014/0339210 | A1 * | 11/2014 | Kobayashi | C21D 1/40 219/162 |

FOREIGN PATENT DOCUMENTS

| | | | |
|---|---|---|---|
| JP | 6137922 | * | 2/1986 |
| JP | 2111817 | * | 4/1990 |
| JP | 04-182075 | | 6/1992 |
| JP | 9-71822 | | 3/1997 |
| JP | 11-339928 | | 12/1999 |
| JP | 2000-271779 | | 10/2000 |
| JP | 2003-290810 | | 10/2003 |
| JP | 2003290810 | * | 10/2003 |
| JP | 2004-058082 | | 2/2004 |
| WO | 02/50316 | | 6/2002 |
| WO | 2009/138869 | | 11/2009 |
| WO | 2013/081180 | | 6/2013 |

OTHER PUBLICATIONS

Translation JP 6137922.*
Yanagimoto et al , J. Materials Processing Technology, vol. 209, Issue 6, Mar. 19, 2009, pp. 3060-3068.*
Asano et al , Continuous Heating Systems Using Electric Resistance Heating for the Hot Rolling of Stainless Steel, ISIJ international, vol. 42 (2002), No. 10, pp. 112-118.*
Translation JP2003290810 (Year: 2019).*
Asano et al (Year: 2002).*
International Search Report for PCT/JP2013/071749, dated Nov. 11, 2013.

* cited by examiner

TEMPERATURE
CENTER POSITION OF WELD BEAD PORTION
POSITION

DIRECT RESISTANCE HEATING METHOD

TECHNICAL FIELD

The present invention relates to a direct resistance heating method which applies electric current to a workpiece such as a steel material.

BACKGROUND ART

Heat treatment is applied to, for example, vehicle structures such as a center pillar and a reinforcement to ensure strength. Heat treatment can be classified into two types, namely, indirect heating and direct heating. An example of indirect heating is a furnace heating in which a workpiece is placed inside a furnace and the temperature of the furnace is controlled to heat the workpiece. Examples of direct heating include induction heating in which an eddy current is applied to a workpiece to heat the workpiece, and a direct resistance heating (also called as a direct electric conduction heating) in which an electric current is applied directly to a workpiece to heat the workpiece.

Some automotive parts are formed by pressing a tailored blank, which is made by, for example, welding plates made of different materials and/or having different thicknesses (see, e.g., JP2004-058082A).

When pressing such a tailored blank, only a portion of the tailored blank may be heated to a quenching temperature, without heating the non-quenching region of the tailored blank to the quenching temperature. To implement this heating, the respective heating temperature may be adjusted by controlling the amount of electric current applied to a pair of electrodes provided on the quenching region of the blank and the amount of electric current applied to another pair of electrodes provided on the non-quenching region of the blank, respectively.

That is, when heating a workpiece like a tailored blank to have a desired temperature distribution, a plurality of pairs of electrodes is provided for a single workpiece, and the amount of electric current applied is controlled for each pair of electrodes. This is undesirable from the viewpoint of facility cost.

SUMMARY OF INVENTION

It is an object of the present invention to provide a direct resistance heating method which makes it less necessary to provide a plurality of pairs of electrodes to heat a workpiece.

According to an aspect of the present invention, a direct resistance heating method includes placing a first electrode and a second electrode such that a space is provided between the first electrode and the second electrode and such that each of the first electrode and the second electrode extends across a heating target region of a workpiece, moving at least one of the first electrode and the second electrode with an electric current being applied between the first electrode and the second electrode, and adjusting a time during which the electric current is applied for each segment region of the heating target region, the segment regions being defined by dividing the heating target region and are arranged side by side along a direction in which the at least one of the first electrode and the second electrode is moved.

The at least one of the first electrode and the second electrode may be moved in the direction along which a resistance per unit length of the workpiece increases, and a moving speed of the at least one of the first electrode and the second electrode may be adjusted in accordance with the increase of the resistance, thereby heating the heating target region of the workpiece to have a given temperature distribution.

The workpiece may be a blank having a welded portion at which a first steel plate and a second steel plate are joined, at least one of materials forming the first steel plate and the second steel plate and thicknesses of the first steel plate and the second steel plate being different from each other. The first electrode and the second electrode may be placed on the first steel plate such that the first electrode is farther from the welded portion than the second electrode, and the first electrode may moved so as not to move across the welded portion, with the electric current being applied between the first electrode and the second electrode. Before the first electrode reaches an end of the first steel plate, the second electrode is moved across the welded portion to reach an end of the second steel plate.

The first electrode may be placed on the first steel plate and the second electrode may be placed on the second steel plate such that the welded portion is disposed between the first electrode and the second electrode, and the first electrode may be moved away from the welded portion and the second electrode, with the electric current being applied between the first electrode and the second electrode. Before the first electrode reaches an end of the first steel plate, the second electrode is moved away from the welded portion and the first electrode.

With the electric current applied between the first electrode and the second electrode being constant, the first electrode may be moved without moving the second electrode to widen the space between the first electrode and the second electrode, and before the first electrode reaches an end of the heating target region, the second electrode may be moved in a direction opposite to the direction in which the first electrode is moved, thereby heating the heating target region such that the heating target region is divided into a high temperature region and a low temperature region.

According to the present invention, the first electrode and the second electrode are placed so as to extend across the heating target region of a workpiece such that a space is provided between the first electrode and the second electrode and at least one of the first electrode and the second electrode is moved as a moving electrode with the electric current being applied between the first electrode and the second electrode.

Accordingly, it is possible to adjust the current applying time for each region (segment region) defined by dividing the heating target region such that the segment regions are arranged side by side in one direction, by aligning the electrode moving direction along one direction of the heating target region of the workpiece and by moving one moving electrode along the one direction or moving two moving electrodes in the same direction or in the opposite directions.

Accordingly, by applying a constant electric current between the first electrode and the second electrode, a predetermined amount of electricity can be supplied to each segment region regardless of the current supply time, and the different amount of electrical energy may be supplied for each segment region or the same amount of electrical energy may be supplied to each segment region. Therefore, it is less necessary to prepare and place pairs of electrodes for the respective segment regions.

BRIEF DESCRIPTION OF DRAWINGS

FIGS. 1A to 1E illustrate a direct resistance heating method according to a first embodiment of the present invention, in which FIG. 1A is a plan view illustrating a state before applying current, FIG. 1B is a front view illustrating a state before applying current, FIG. 1C is a plan view illustrating a state after the current has been applied, FIG. 1D is a front view illustrating a state after the current has been applied and FIG. 1E is a diagram illustrating the temperature distribution of a workpiece;

FIGS. 7A to 7E illustrate a direct resistance heating method according to a second embodiment of the present invention, in which FIG. 7A is a plan view illustrating a state before applying current, FIG. 7B is a front view illustrating a state before applying current, FIG. 7C is a plan view illustrating a state after the current has been applied, FIG. 7D is a front view illustrating a state after the current has been applied and FIG. 7E is a diagram illustrating the temperature distribution of a workpiece;

FIGS. 8A to 8E illustrate a direct resistance heating method according to a third embodiment of the present invention, in which FIG. 8A is a plan view illustrating a state before applying current, FIG. 8B is a front view illustrating a state before applying current, FIG. 8C is a plan view illustrating a state after the current has been applied, FIG. 8D is a front view illustrating a state after the current has been applied and FIG. 8E is a diagram illustrating the temperature distribution of a workpiece;

FIGS. 9A to 9G illustrate a direct resistance heating method according to a fourth embodiment of the present invention, in which FIG. 9A is a plan view illustrating a state before applying current, FIG. 9B is a front view illustrating a state before applying current, FIG. 9C is a plan view illustrating a state while the current is being applied, FIG. 9D is a front view illustrating a state while the current is being applied, FIG. 9E is a plan view illustrating a state after the current has been applied, FIG. 9F is a front view illustrating a state after the current has been applied and FIG. 9G is a diagram illustrating the temperature distribution of a workpiece;

FIGS. 10A to 10G illustrate a direct resistance heating method according to a fifth embodiment of the present invention, in which FIG. 10A is a plan view illustrating a state before applying current, FIG. 10B is a front view illustrating a state before applying current, FIG. 10C is a plan view illustrating a state while the current is being applied, FIG. 10D is a front view illustrating a state while the current is being applied, FIG. 10E is a plan view illustrating a state after the current has been applied, FIG. 10F is a front view illustrating a state after the current has been applied and FIG. 10G is a diagram illustrating the temperature distribution of a workpiece; and FIGS. 11A to 11I illustrate a direct resistance heating method according to a sixth embodiment of the present invention, in which FIG. 11A is a plan view illustrating a state before applying current, FIG. 11B is a front view illustrating a state before applying current, FIG. 11C is a plan view illustrating a state after the current has been applied in the first step, FIG. 11D is a front view illustrating a state after the current has been applied in the first step, FIG. 11E is a plan view illustrating a state before applying current in the second step, FIG. 11F is a front view illustrating a state before applying current in the second step, FIG. 11G is a plan view illustrating a state after the current has been applied, FIG. 11H is a front view illustrating a state after the current has been applied and FIG. 11I is a diagram illustrating the temperature distribution of a workpiece.

DESCRIPTION OF EMBODIMENTS

Figure 1A:
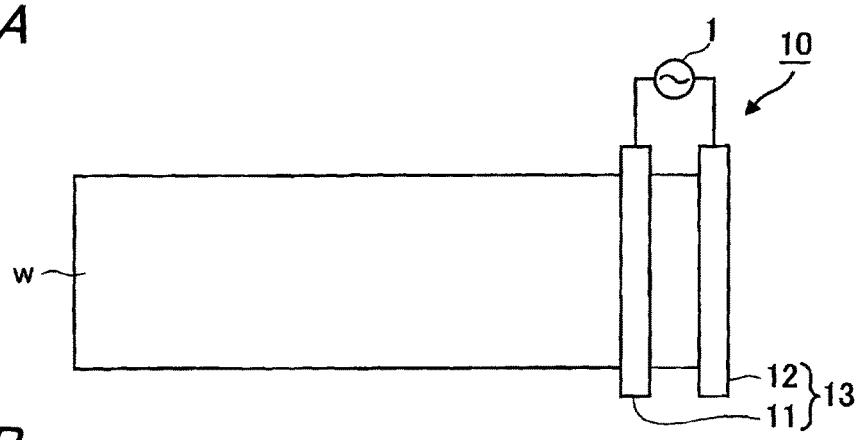
Figure 1B:
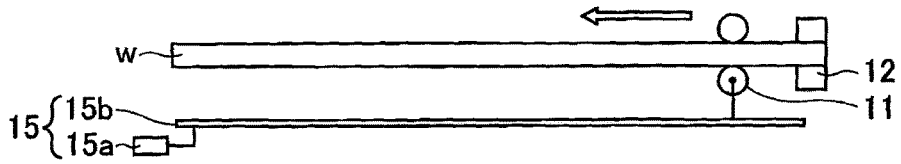

Hereinafter, embodiments of the present invention will be described with reference to the drawings. To implement the present invention, there is no limitation to a width of a workpiece as seen in a plan view or to a thickness of the workpiece. An opening or a cut-out region may be provided in a region of the workpiece to be hated (hereinafter, "heating target region"). The "heating target region" a region to be heated that is determined in advance with respect to the workpiece and is different from a region on the workpiece where electric current is to be applied by the electrodes contacting the workpiece. This is because there is a possibility that an electrode is not disposed along each side of the heating target region but disposed obliquely with respect to each side of the heating target region. The workpiece is, for example, a steel material that can be heated by applying the electric current therethrough. The workpiece may be configured by a single piece or may be configured by an integral body obtained by joining the materials with different resistivity or thickness by welding or the like. Further, the workpiece may be provided with one heating target region or a plurality of heating target regions. When the workpiece is provided with a plurality of heating target regions, the plurality of heating target regions may be adjacent to each other or may be spaced apart from each other, instead of being adjacent to each other.

A direct resistance heating apparatus 10 for performing a direct resistance heating method according to a first embodiment of the present invention will be described with reference to FIGS. 11A to 11E. The direct resistance heating apparatus 10 includes a pair of electrodes 13 and a moving mechanism 15. The pair of electrodes 13 is electrically coupled to a power feeding unit 1 and includes a first electrode 11 and the second electrode 12. The moving mechanism 15 is configured to move one or both of the first electrode 11 and the second electrode 12.

In a state in which the first electrode 11 and the second electrode 12 are brought into contact with a workpiece w and in which electric current is being applied to the workpiece w from the power feeding unit 1 through the pair of electrodes 13, the moving mechanism 15 moves the first electrode 11 to change the distance between the first electrode 11 and the second electrode 12. Here, the workpiece w is fixed and does not move.

In the example shown in FIGS. 1A to 1E, the first electrode 11 is a moving electrode since the first electrode 11 is moved by the moving mechanism 15 and the second electrode 12 is a fixed electrode since the second electrode 12 does not move while contacting the workpiece w. In other instances, the second electrode 12 may be a moving electrode and the first electrode 11 may be a fixed electrode, or both the first electrode 11 and the second electrode 12 may be a moving electrode. In a case where the second electrode 12 serves as a moving electrode, the moving electrode is moved by a moving mechanism similar to the moving mechanism 15.

The moving mechanism 15 moves the moving electrode while adjusting a moving speed of the moving electrode, from the start of current supply from the power feeding unit 1 to the pair of electrodes 13 to the end of the current supply. In this way, it is possible to control the current applying time for each region (hereinafter, "segment region") which is defined by dividing the heating target region along a moving direction of the moving electrode. That is, the heating target region can be considered as a row of segment regions, each having the width of the workpiece w as seen in a plan view and sequentially arranged side by side along the moving direction of the electrode, so that given electrical energy is applied to each segment region.

In an aspect shown in FIG. 1, for simplicity of explanation, the entire region of the workpiece w is consistent with the heating target region and the width of the workpiece is constant regardless of the moving direction of the electrode. Accordingly, it is possible to control the magnitude of heat amount generated in each segment region by adjusting a moving speed of the first electrode 11 using the moving mechanism 15 while applying a constant electric current to the workpiece w from the power feeding unit 1 via the pair of electrodes 13.

The moving mechanism 15 includes an adjusting unit 15*a* configured to control a moving speed of the moving one of the first electrode 11 and the second electrode 12, and a drive mechanism 15*b* configured to move the moving electrode. The adjusting unit 15*a* is configured to calculate a moving speed of the electrode to be moved from data on the shapes and dimensions of the workpiece w or the heating target region and the drive mechanism 15*b* is configured to move the electrode to be moved by the calculated moving speed. The moving speed calculated by the adjusting unit 15*a* will be described below.

Figure 2:
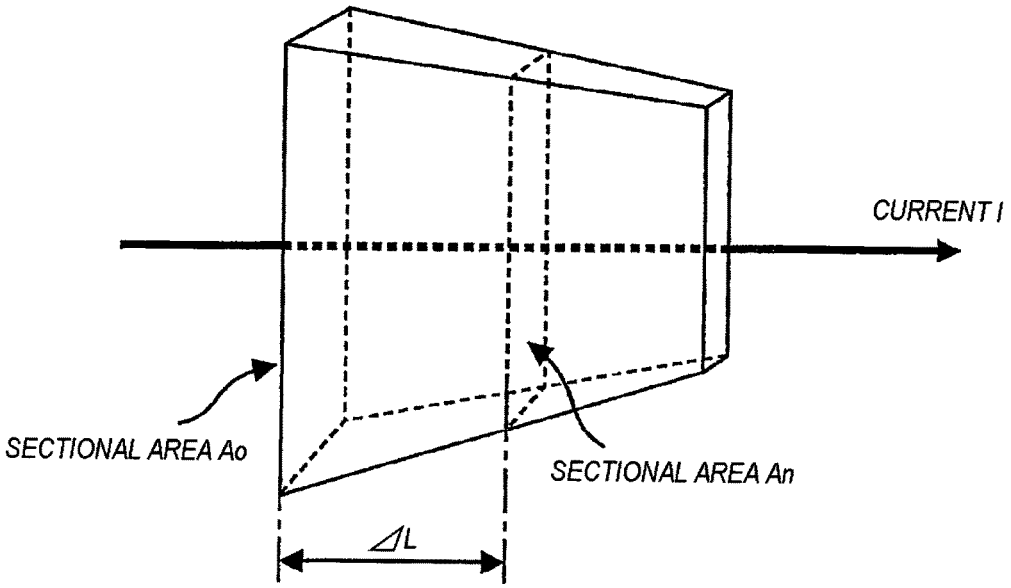
FIG. 2 is a diagram for explaining a basic relational expression in a direct resistance heating.

As shown in FIG. 2, where the temperature rises by $\theta_0$ by applying current I to a cross-sectional area $A_0$ in unit length for a period of time $t_0$ (s), the following formula (1) is established.

$$\theta_0=\rho_{e0}/(\rho_0\cdot C_0)\times(I^2\times t_0)/A_0^2(^\circ\text{ C.}) \quad \text{Formula(1)}$$

wherein $C_0$ is specific heat (J/kg·° C.), $\rho_0$ is density (kg/m$^3$) and $\rho_{e0}$ is resistivity (Ω·m).

Where the temperature rises by $\theta_n$ by applying current I to a cross-sectional area $A_n$ in unit length for a period of time $t_n$ (s), the following formula (2) is established.

$$\theta_n=\rho_{en}/(\rho_n\cdot C_n)\times(I^2\times t_n)/A_n^2(^\circ\text{ C.}) \quad \text{Formula(2)}$$

wherein $C_n$ is specific heat (J/kg·(° C.)), $\rho_n$ is density (kg/m$^3$) and $\rho_{en}$ is resistivity (Ω·m).

Relationship between the time $t_0$ and the time $t_n$ is represented in the following formula (3) when the cross-sectional areas have a relationship of $A_0 \geq A_n$, the current I is constant and a temperature gradient of $\theta_0 > \theta_n$ is set.

$$(\theta_0\rho_0\cdot C_0)/\rho_{e0}\times A_0^2/t_0=(\theta_n\cdot\rho_n\cdot C_n)/\rho_{en}\times A_n^2/t_n \quad \text{Formula(3)}$$

A temperature term and a temperature-dependent term are organized as indicated in the following formulae (4) and (5) and considered as $k\theta_0$ and $k\theta_n$.

$$(\theta_0\cdot\rho_0\cdot C_0)/\rho_{e0}=k\theta_0 \quad \text{Formula (4)}$$

$$(\theta_n\cdot\rho_n\cdot C_n)/\rho_{en}=k\theta_n \quad \text{Formula (5)}$$

Then, the formula (3) has the same value as the formula (6) and the formula (7) is calculated.

$$k\theta_0\times A_0^2/t_0=k\theta_n\times A_n^2/t_n \quad \text{Formula (6)}$$

$$t_0=k\theta_n/k\theta_0\times(A_0/A_n)^2\times t_0 \quad \text{Formula (7)}$$

When a temperature rise ratio n is defined as $k\theta_n/k\theta_0$, the following formula (8) is obtained from the formula (7).

$$t_n=n\times(A_n/A_0)^2\times t_0 \quad \text{Formula (8)}$$

In a case where a constant current I is applied and heating is performed so as to allow portions with different cross-sectional area to have a temperature gradient, the time during which the current is applied to a certain cross section is proportional to the temperature rise ratio and also proportional to the square of the cross-sectional area ratio. As a result, the speed ΔV of the moving electrode can be calculated as indicated in the following formula (9).

$$\Delta V=\Delta L/(t_0-t_n) \quad \text{Formula (9)}$$

The formula (8) and the formula (9) are available only when the following formula (10) is established.

$$(k\theta_n/k\theta_0)\times(A_n/A_0)^2\geq 1 \quad \text{Formula (10)}$$

Herein, when the cross-sectional area of the workpiece w is constant in the moving direction of the electrode, as shown in FIG. 1, the current applying time is proportional to the temperature rise ratio n. Accordingly, in a case where it is desired to set the temperature gradient to be constant and the value of the temperature rise to be reduced along the moving direction of the electrode, a distance between the electrodes may be increased over time by moving the first electrode 11 in a constant speed.

Further, when the cross-sectional area of the workpiece w is reduced along the moving direction of the electrode, the current applying time is proportional to the square of the cross-sectional area ratio and proportional to the temperature rise ratio. Accordingly, in a case where it is desired to set the temperature gradient to be constant and the value of the temperature rise to be reduced along the moving direction of the electrode, the first electrode 11 may be moved according to the square of the cross-sectional area ratio.

Basically, the first electrode 11 is moved so as to satisfy the formula (9). Depending on the size and/or temperature distribution of the workpiece w, the pair of electrodes is arranged such that a relationship of $n(A_n/A_0)^2 \leq 1$ is established.

Figure 1C:
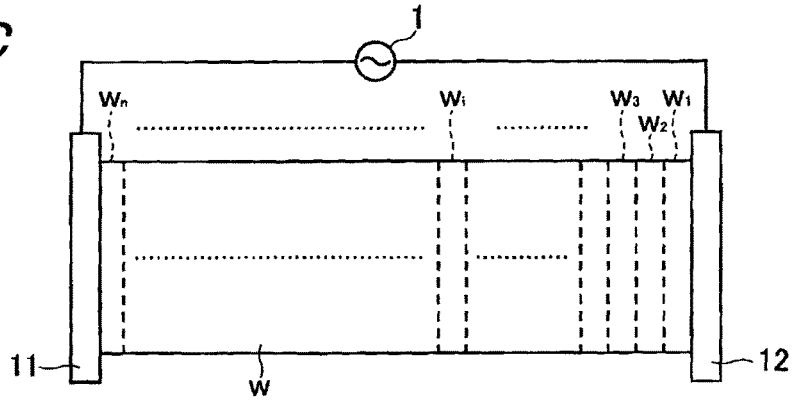
Figure 1D:
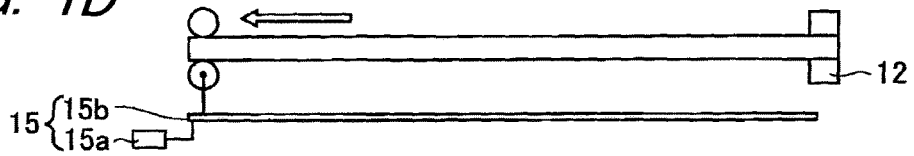
Figure 1E:
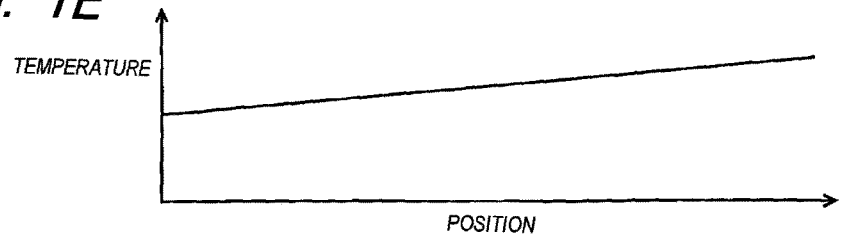

As described above, the adjusting unit 15*a* can calculate the moving speed from the data on the shape and dimensions of the plate-shaped workpiece w such as a steel material and the temperature distribution set in the workpiece w. As shown in FIG. 1C, the heating target region of the workpiece w is divided into n segment regions $w_1$ to $w_n$. Each of the segment regions has two sides, namely, one side having a length corresponding to the width of the workpiece w and another side having a length obtained by equally dividing the longitudinal length of the heating target region by the number n. In this way, the heating target region is divided into strips and the segment regions $w_1$ to $w_n$ are arranged side by side along the moving direction of the electrode. As described above, the current applying time for the segment regions $w_1$ to $w_n$ can be adjusted by moving the first electrode 11. By doing so, it is possible to secure the amount of electricity in each segment region in response to the resistance value of the segment regions. Further, it is possible to heat the heating target region of the workpiece w to have a desired temperature distribution, e.g., a uniform temperature distribution.

Here, the power feeding unit 1 may be an AC power supply as well as a DC power supply. When average current in one period is not changed even in the case of the AC power supply, it is possible to heat the workpiece in a predetermined temperature distribution by adjusting the current applying time for each segment region. Each of the electrodes has a length that can extend across the heating target region of the workpiece w in a direction intersecting the moving direction of the electrode. The reason is that, if the electrodes do not extend across each region defined by dividing into stripes, the amount of electricity becomes different in the width direction in each region.

In this way, according to the direct resistance heating method of the first embodiment of the present invention, the first electrode 11 is moved according to the change in resistance per unit length in the moving direction of the electrode and the current applying time for respective strip-shaped segment regions to form the heating target region is adjusted. The amount of electricity supplied to each segment region can be adjusted and the heating target region can be heated in a predetermined temperature distribution. At that time, the current applying time for each segment region can be determined by the moving speed of the first electrode 11. Here, "resistance per unit length" means resistance in each region when the workpiece w is divided along the longitudinal direction into minute regions $w_1$ to $w_n$, for example, as shown in FIG. 1C. The "resistance per unit length" may be referred to as "resistance per minute length", "cross-sectional area having minute length" or just "cross-sectional area of minute length".

For example, in a case in which the heating target region of the workpiece has a substantially constant width along the longitudinal direction of the workpiece, the first electrode 11 may be moved by the moving mechanism 15 with the electric current being applied from the power feeding unit 1 to the pair of electrodes 13. Accordingly, there is no need to provide a plurality of pairs of electrodes t both ends of the heating target region of the workpiece w in accordance with a temperature distribution and to control the supply amount of current in accordance with the temperature distribution, as in the related art.

Next, a detailed configuration of an example of a direct resistance heating apparatus for performing the direct resistance heating method shown in FIGS. 1A to 1E will be described with reference to FIGS. 3 to 6. As shown in FIGS. 3 to 6, each electrodes 21, 22 of a direct resistance heating apparatus 20 is configured by electrode portions 21*a*, 22*a* and auxiliary electrode portions 21*b*, 22*b*, which hold the workpiece w therebetween in a vertical direction.

Figure 3:
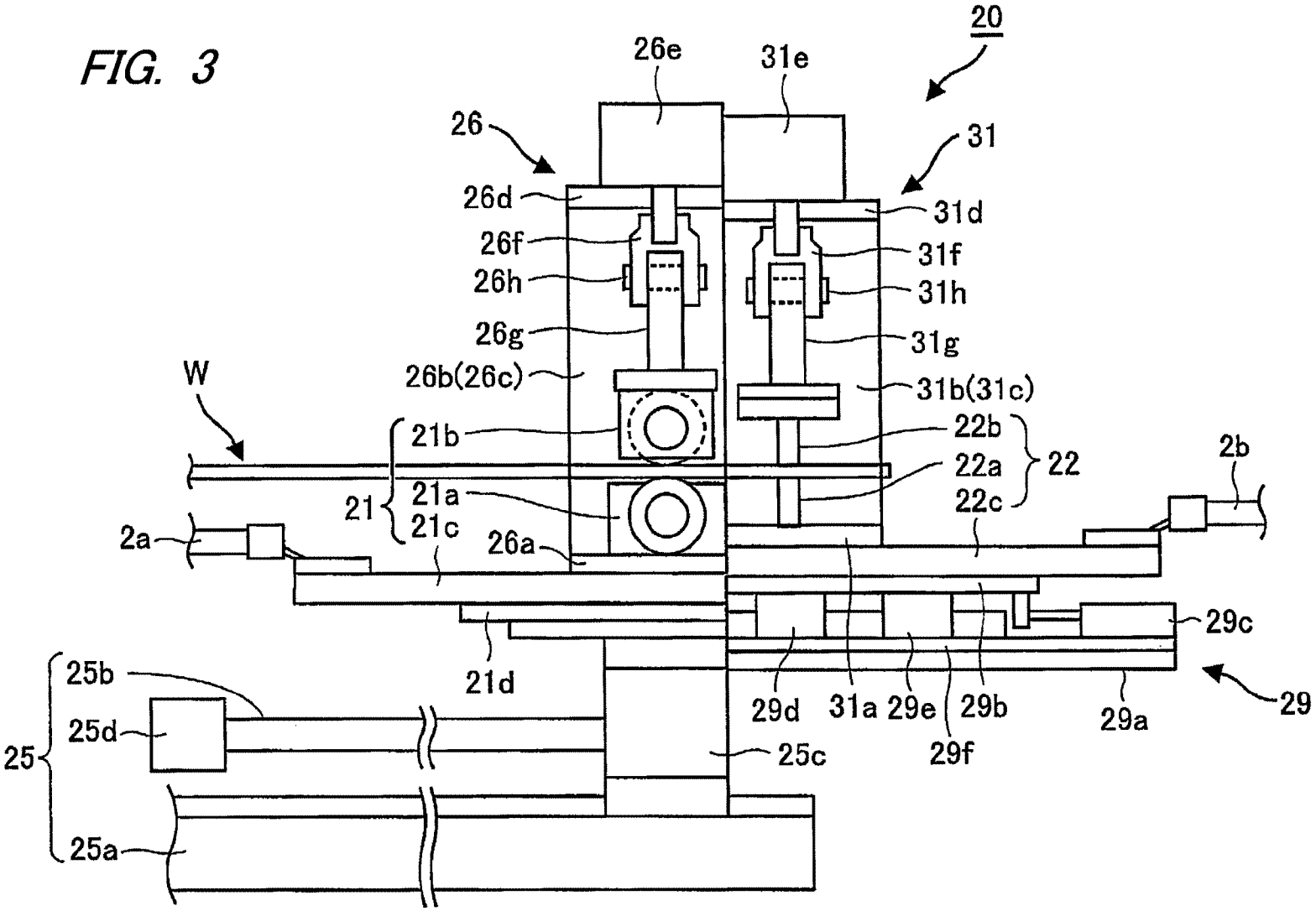
FIG. 3 is a front view of a direct resistance heating apparatus for performing the direct resistance heating method illustrated in FIGS. 1A to 1E.
Figure 4:
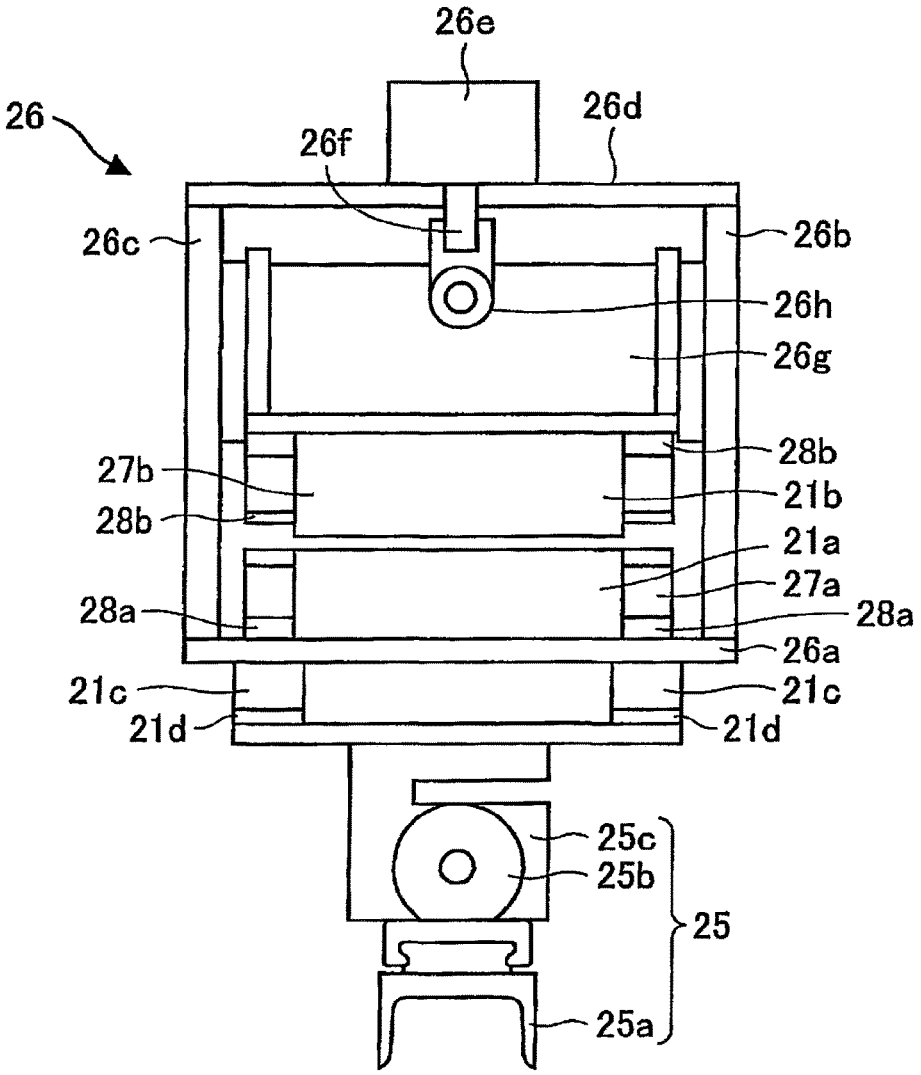
FIG. 4 is a left side view of the direct resistance heating apparatus of FIG. 3.
Figure 5:
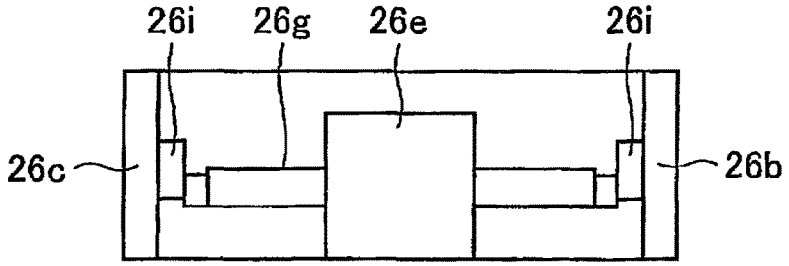
FIG. 5 is a plan view of a portion of the direct resistance heating apparatus of FIG. 3.
Figure 6:
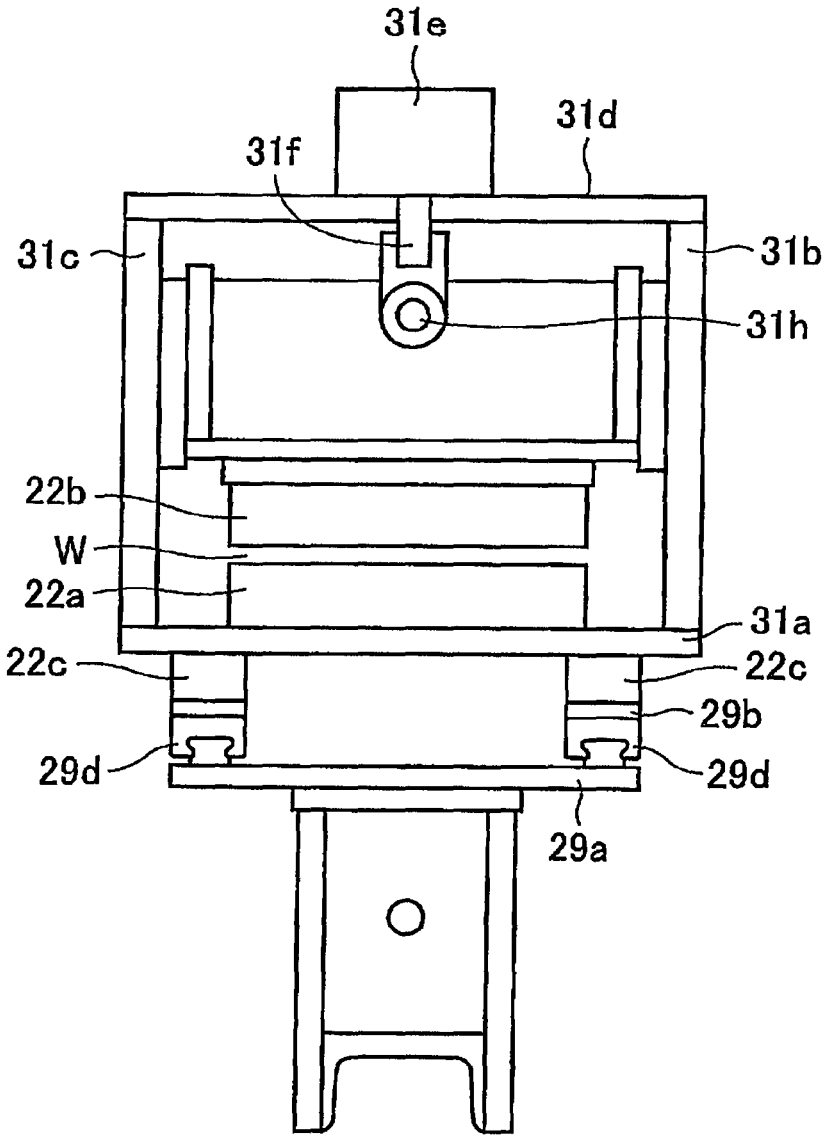
FIG. 6 is a right side view of the direct resistance heating apparatus of FIG. 3.

In FIG. 3, a moving electrode 21 is disposed on the left side and a fixed electrode 22 is disposed on the right side, as seen from the front. The moving electrode 21 and the fixed electrode 22 respectively include paired lead parts 21*c*, 22*c*, the electrode portions 21*a*, 22*a* coming into contact with the workpiece w and the auxiliary electrode portions 21*b*, 22*b* for pressing the workpiece w toward the electrode portions 21*a*, 22*a*.

As shown in FIG. 3, a moving mechanism 25 is configured as follows. A guide rail 25*a* extends in the left and right direction. A movement control rod 25*b* configured by a screw shaft is disposed above the guide rail 25*a* so as to extend in the left and right direction. The movement control rod 25*b* is screwed to a slider 25*c* sliding on the guide rail 25*a*. The slider 25*c* is moved in the left and right direction by rotating the movement control rod 25*b* by a step motor 25*d* while adjusting the speed thereof.

The lead part 21*c* for the moving electrode 21 is disposed on the slider 25*c* via an insulation plate 21*d*. A wiring 2*a* is electrically coupled to the power feeding unit 1 and fixed to one end of the lead part 21*c*. The electrode portion 21*a* of the moving electrode 21 is fixed to the other end of the lead part 21*c*. A suspending mechanism 26 is disposed in which the auxiliary electrode portion 21*b* of the moving electrode 21 is disposed so as to be movable in a vertical direction.

The suspending mechanism 26 is provided on a mounting frame having a stage 26*a*, walls 26*b*, 26*c* and a bridging portion 26*d*. That is, the suspending mechanism 26 includes a pair of walls 26*b*, 26*c* that are spaced apart from each other in a width direction and provided on the other end of the stage 26*a*, the bridging portion 26*d* bridging the upper ends of the walls 26*b*, 26*c*, a cylinder rod 26*e* mounted on an axis of the bridging portion 26*d*, a clamping portion 26*f* mounted to a leading end of the cylinder rod 26*e*, and a holding plate 26*g* holding the auxiliary electrode portion 21*b* in an insulating manner. The leading end of the cylinder rod 26*e* is fixed to an upper end of the clamping portion 26*f* and supporting portions 26*i* are respectively provided on the opposing surface of the walls 26*b*, 26*c*, so that the holding plate 26*g* can be swingably guided by a connecting shaft 26*h*. As the cylinder rod 26*e* is moved in a vertical direction, the holding part 26*f*, the connecting shaft 26*h*, the holding plate 26*g* and the auxiliary electrode portion 21*b* are moved in a vertical direction. The electrode portion 21*a* and the auxiliary electrode portion 21*b* of the moving electrode 21 extend so as to extend across the heating target region of the workpiece w. Therefore, the entire upper surface of the electrode portion 21*a* and the entire lower surface of the auxiliary electrode portion 21*b* can be pressed against the workpiece w by being swung by the connecting shaft 26*h*.

In order to hold the electrode portion 21*a* and the auxiliary electrode portion 21*b* of the moving electrode 21 in contact with the plate-shaped workpiece w even when the suspending mechanism 26 and the lead part 21*c* for the moving electrode 21 are moved in the left and right direction by the moving mechanism 25, rollers 27*a*, 27*b* are disposed in both the electrode portion 21*a* and the auxiliary electrode portion 21*b* of the moving electrode 21 so as to extend across the workpiece w in a width direction of the workpiece w. The rollers 27*a*, 27*b* can be freely rolled by a pair of bearings 28*a*, 28*b*. Even when the electrode portion 21*a* and the auxiliary electrode portion 21*b* are moved in the left and right direction by the moving mechanism 25, it is possible to maintain a state in which the electric current is applied to the workpiece w via a pair of bearings 28*a*, 28*b* and the roller 27*a*.

The fixed electrode 22 is provided on the other side of the direct resistance heating apparatus 20. As shown in FIG. 3, a pulling mechanism 29 for the fixed electrode 22 is disposed on a stage 29*a*. The lead part 22*c* for the fixed electrode is disposed on the pulling mechanism 29 for the fixed electrode via an insulation plate 29*b*. The wiring 2*b* electrically coupled to the power feeding unit 1 is fixed to one end of the lead part 22*c*. The electrode portion 22*a* of the fixed electrode 22 is fixed to the other end of the lead part 22*c*. A suspending mechanism 31 in which the auxiliary electrode portion 22*b* of the fixed electrode 22 is disposed movably in a vertical direction is arranged so as to cover the electrode portion 22*a*.

The pulling mechanism 29 for the fixed electrode includes a moving means 29*c* connected to a lower surface of the insulation plate 29*b* to move the stage 29*a* in the left and right direction, sliders 29*d*, 29*e* for directly sliding the insulation plate 26*b* in the left and right direction and a guide rail 29*f* for guiding the sliders 29*d*, 29*e*. The position of the pulling mechanism 29 is adjusted by sliding the auxiliary electrode portion 22*b*, the electrode portion 22*a* and the lead part 22*c* in the left and right direction by the moving means 29*c*. By providing the pulling mechanism 29 in the direct resistance heating apparatus 20 in this manner, it is possible to flatten the workpiece w even when the workpiece w is expanded due to the direct resistance heating.

The suspending mechanism 31 includes a pair of walls 31*b*, 31*c* that are spaced apart from each other in a width direction and erected on the other end of a stage 31*a*, a bridging portion 31*d* bridging the upper ends of the walls 31*b*, 31*c*, a cylinder rod 31*e* mounted on an axis of the bridging portion 31*d*, a clamping portion 31*f* mounted to a leading end of the cylinder rod 31*e*, and a holding plate 31*g* holding the auxiliary electrode portion 22*b* in an insulating manner. The holding plate 31*g* is clamped by the clamping portion 31*f* via a connecting shaft 31*h*. The leading end of the cylinder rod 31*e* is fixed to an upper end of the clamping portion 31*f*. Similarly to the suspending mechanism 26, the holding plate 31*g* is swingably supported by supporting portions which are respectively provided on the opposing surface of the walls 31*b*, 31*c*. As the cylinder rod 31*e* is moved in a vertical direction, the clamping portion 31*f*, the connecting shaft 31*h*, the holding plate 31*g* and the auxiliary electrode portion 22*b* are moved in a vertical direction. The electrode portion 22*a* and the auxiliary electrode portion 22*b* of the fixed electrode 22 extend across the heating target region of the workpiece w. Therefore, the entire upper surface of the electrode portion 22*a* and the entire lower surface of the auxiliary electrode portion 22*b* can be pressed against the workpiece w by being swung by the connecting shaft 31*h*.

Although not shown in FIGS. 3 to 6, the workpiece w is horizontally supported by horizontally supporting means. The workpiece w is securely held between the electrode portion 22*a* and the auxiliary electrode portion 22*b* of the fixed electrode 22. The workpiece w is also held between the electrode portion 21*a* and the auxiliary electrode portion 21*a* of the moving electrode 21. The electrode portion 21*a* and the auxiliary electrode 21*b* are moved by the moving mechanism 25. The moving electrode 21 is moved by the moving mechanism 25 while a moving speed thereof is controlled by the speed adjusting unit 15*a*. Accordingly, by adjusting the moving speed of the electrode portion 21*a* and the auxiliary electrode portion 21*b* of the moving electrode 21 by the speed adjusting unit 15*a* in accordance with the shape of the workpiece w, the heating target region of the workpiece w can be heated such that, for example, the temperature distribution in the heating target region is smoothly changed from a high-temperature region to a low-temperature region.

In this way, in the direct resistance heating apparatus 20, the electrode portion 21*a* and the auxiliary electrode portion 21*b* are placed so as to sandwich the workpiece w from the upper and lower. The electrode portion 21*a* has a solid structure and extends across the heating target region of the workpiece w. The electrode portion 21*a* is provided so as to bridge a pair of lead parts 21*c* (bus bars) arranged along an electrode moving direction. The electrode portion 21*a*, the auxiliary electrode portion 21*b* and a pair of lead parts 21*c* are attached to a means which is moved along the electrode moving direction by the moving mechanism 25. At least one of the electrode portion 21*a* and the auxiliary electrode portion 21*b* is vertically moved by the cylinder rod 26*e* as a pressing means and therefore runs on the workpiece w while sandwiching the workpiece w by the electrode portion 21*a* and the auxiliary electrode portion 21*b*. In this way, the electrode portion is moved with the electric current being applied from the electrode portion 21*b* to the workpiece w via the bus bar 21*c*.

In addition to the embodiment shown in FIG. 3 to FIG. 6, the following configuration may be employed. That is, in a state where at least one of the electrode portion 21*a* and the auxiliary electrode portion 21*b* is vertically moved by the cylinder rod 26*e* as a pressing means and therefore the workpiece w is held between the electrode portion 21*a* and the auxiliary electrode portion 21*b*, the electrode portion 21*a* runs on a pair of bus bars so that it is moved with the electric current being applied from the electrode portion 21*b* to the workpiece w via the bus bars 21*c*.

Next, a direct resistance heating method according to a second embodiment of the present invention will be described with reference to FIGS. 7A to 7E.

As shown in FIGS. 7A to 7D, a direct resistance heating apparatus 40 for performing the direct resistance heating method according to the second embodiment includes a pair of electrodes 43 and moving mechanisms 44, 45. The pair of electrodes 43 is electrically coupled to the power feeding unit 1 and includes a first electrode 41 and the second electrode 42. The moving mechanisms 44, 45 are configured to move the first electrode 41 and the second electrode 42.

Figure 7A:
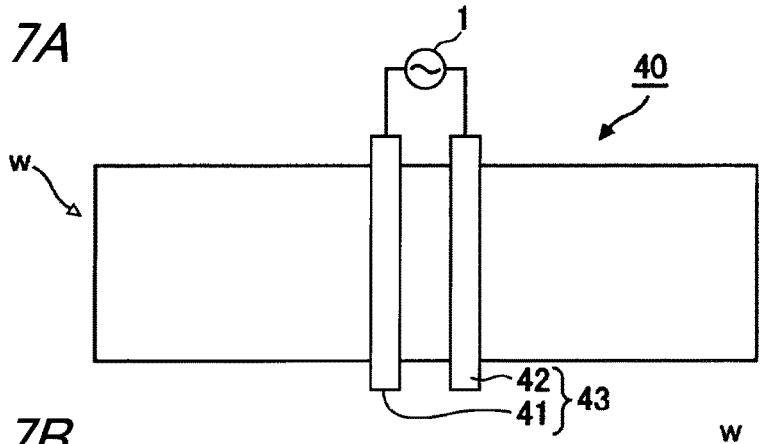
Figure 7B:
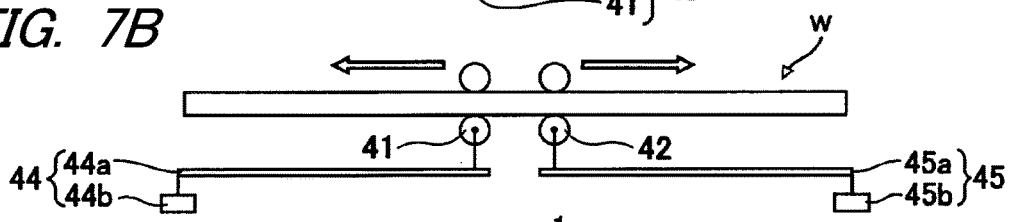
Figure 7C:
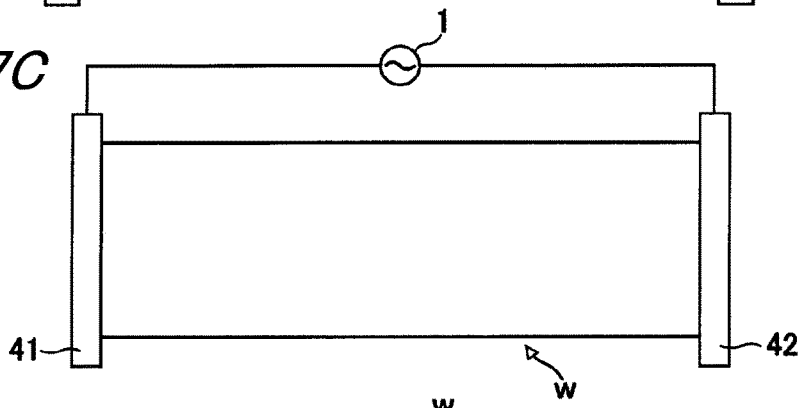
Figure 7D:
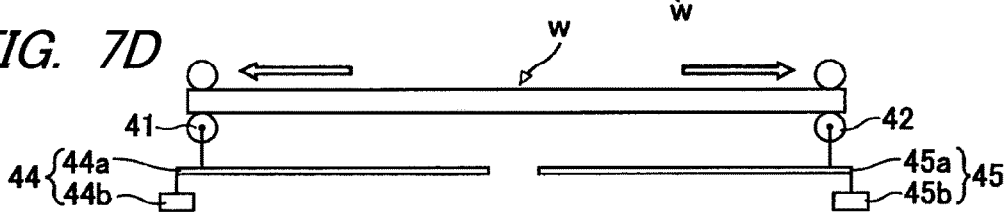
Figure 7E:
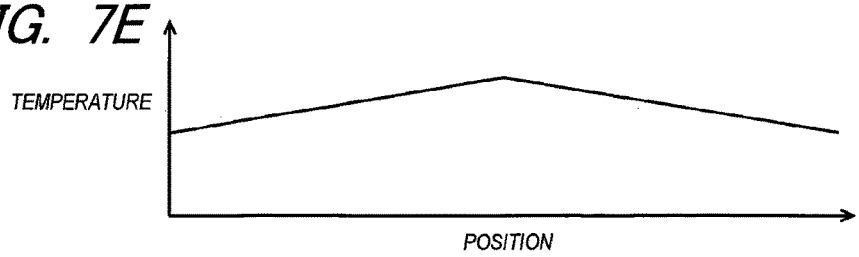

Unlike the first embodiment, in the second embodiment, the moving mechanisms 44, 45 are provided to move the first electrode 41 and the second electrode 43, which are arranged so as not to contact with each other, in opposite directions, in a state in which the first electrode 41 and the second electrode 42 are in contact with the workpiece w and in which electric current is applied to the workpiece w from the power feeding unit 1 via the pair of electrodes 43. By doing so, the space between the first electrode 41 and the second electrode 42 is widened. As shown in FIG. 7E, the workpiece w can be heated to have a temperature distribution in which the heating temperature at a center equidistant from both ends of the workpiece w is high and the heating temperature at both ends is low. Although the moving speed of the first electrode 41 is equal to that of the second electrode 42 in FIG. 7E, the first electrode and the second electrode may be moved respectively in a separate speed, depending on the temperature distribution to be set.

The apparatus according to the second embodiment may be configured such that the moving electrode arranged on the left in the first embodiment shown in FIG. 3 to FIG. 6 is also arranged in the right.

Next, a direct resistance heating method according to a third embodiment of the present invention will be described with reference to FIGS. 8A to 8E.

As shown in FIG. 8A to 8D, a direct resistance heating apparatus 50 for performing the direct resistance heating method according to the third embodiment includes a pair of electrodes 53 and a moving mechanism 55. The pair of electrodes 53 is electrically coupled to the power feeding unit 1 and includes a first electrode 51 and the second electrode 52. The moving mechanism 55 is configured to move both of the first electrode 41 and the second electrode 42 at the same time.

In the third embodiment, the moving mechanism 55 is configured to move the first electrode 51 and the second electrode 53, which are arranged so as not to contact with each other, in a state in which the first electrode 51 and the second electrode 52 are in contact with the workpiece w and in which constant electric current is applied to the workpiece w from the power feeding unit 1 via the pair of electrodes 53.

Figure 8A:
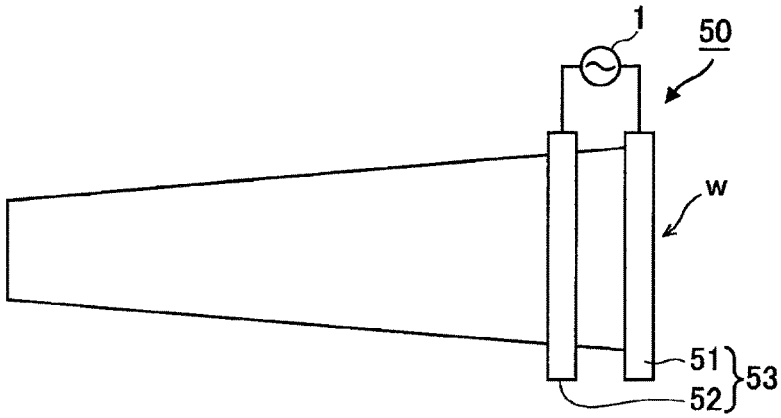
Figure 8B:
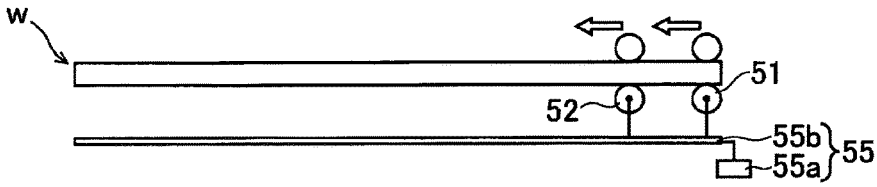
Figure 8C:
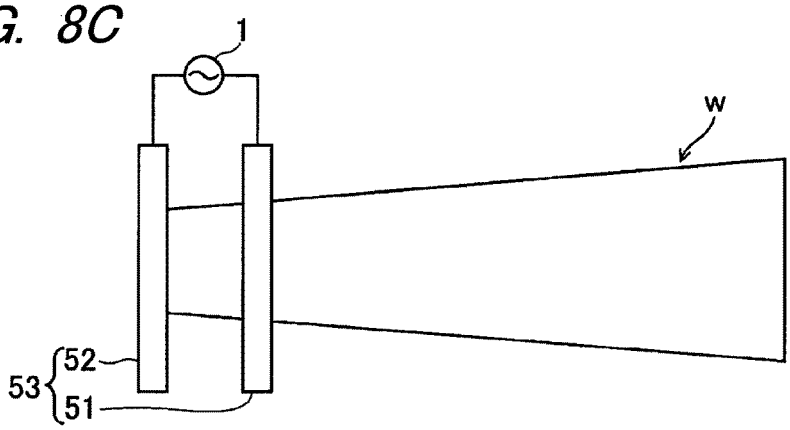
Figure 8D:
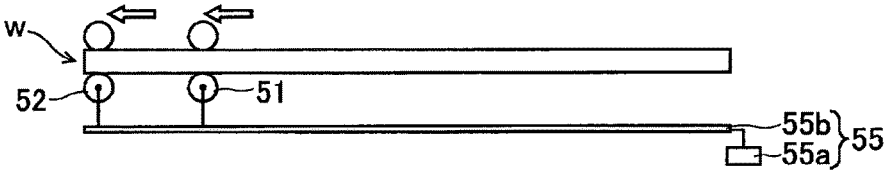

As shown in FIGS. 8A and 8B, the first electrode 51 is placed on one end of the heating target region of the workpiece w and the second electrode 52 is placed on the heating target region of the workpiece w at a position spaced apart from the first electrode 51 by a predetermined length. Then, the first electrode 51 and the second electrode 52 are moved in one direction on the workpiece w at the same speed by a drive mechanism 55*b* while keeping a constant interval in accordance with a command from an adjusting unit 55*a* of the moving mechanism 55, with the electric current being applied to the pair of electrodes 53 from the power feeding unit 1. As shown in FIGS. 8C and 8D, when the second electrode 52 reaches the other end of the heating target region of the workpiece w, the movement by the drive mechanism 55*b* is stopped and the current supply from the power feeding unit 1 is stopped.

Figure 8E:
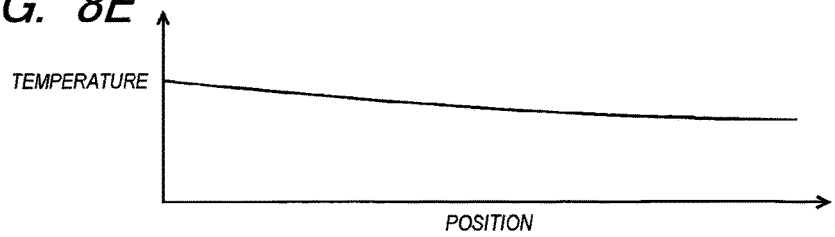

The adjusting unit 55*a* is able to heat the heating target region of the workpiece w so that each segment region has a temperature distribution shown in FIG. 8E by calculating the moving speed of the first electrode 51 and the second electrode 52 based on the dimensions including the shape of the heating target region of the workpiece w and a desired temperature distribution and controlling the drive mechanism 55*b*. In this case, since the first electrode 51 and the second electrode 52 are moved at the same speed, the distance between the first electrode 51 and the second electrode 52 is kept constant during power supply.

For a specific apparatus configuration of the third embodiment, the fixed electrode 22 of the first embodiment shown may be configured to have similar configuration as the moving electrode 21, the electrode portions of the left and right moving electrodes may be placed on a separate lead part via a stage, respectively, and each lead part may be disposed on the same moving mechanism via an insulation plate. Alternatively, like in the second embodiment, the first electrode and the second electrode may be controlled by a separate moving mechanism, respectively.

Next, a direct resistance heating method according to a fourth embodiment of the present invention will be described with reference to FIGS. 9A to 9G.

A direct resistance heating apparatus 40 shown in FIGS. 9A to 9F has similar configuration as the direct resistance heating apparatus 40 shown in FIG. 7A to 7D. The difference is that one side of the workpiece w is a region $w_1$ to be heated to a hot working temperature, that is, a quenching temperature, and the other side of the workpiece w is a region $w_2$ to be heated to a warm working temperature lower than the quenching temperature. The entire region of the workpiece w has the regions $w_1$, $w_2$ that are heated to different temperatures, respectively. The workpiece w may include regions other than the region $w_1$ and the region $w_2$. The workpiece w is a tailored blank which is obtained by joining two regions $w_1$, $w_2$ made of different materials by welding at a weld bead portion 3. The tailored blank is obtained by joining the steel plates having different thickness or strength by welding or the like, and is a state before being processed in the press or the like. In this case, both of the moving electrodes 41, 42 are respectively moved by the moving mechanism 44, 45. The region $w_1$ on the left is heated to the hot working temperature whereas the region $w_2$ on the right is heated to the warm working temperature, so that these regions can be easily pressed in a subsequent process.

Figures 9A, 9B, 9C, 9D, 9E, 9F, 9G:
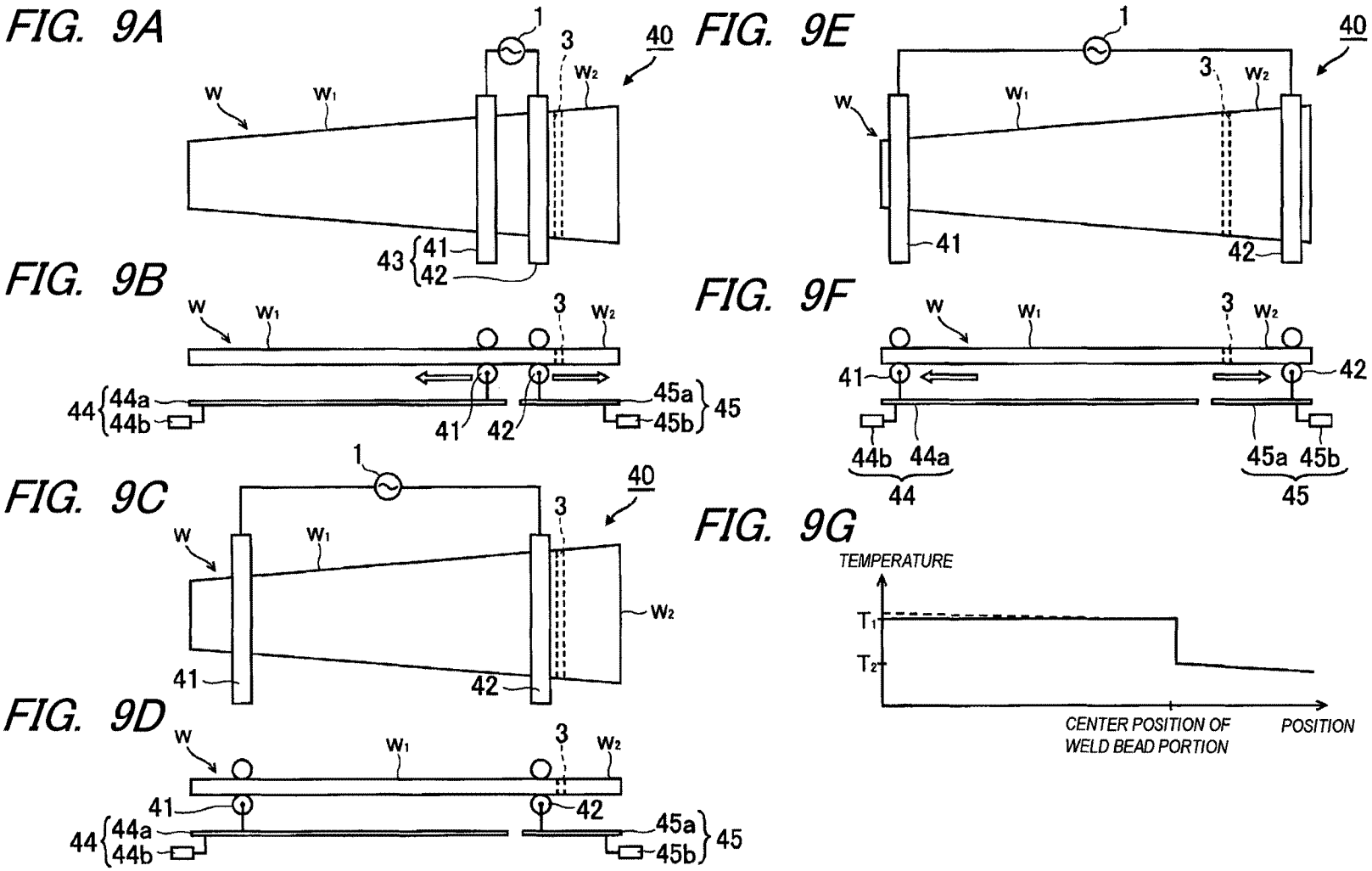

First, the first electrode 41 and the second electrode 42 are placed at an intermediate portion of the heating target region. In the example of FIGS. 9A and 9B, the electrodes are placed on the region $w_1$ is a spaced manner. The second electrode 42 is placed on the region $w_1$ so as not to touch the weld bead portion 3.

Thereafter, in a state in which the second electrode 42 is fixed without moving with a constant electric current being applied between the first electrode 41 and the second electrode 42, the moving mechanism 44 moves the first electrode 41 away from the second electrode 42 and therefore the space between the first electrode 41 and the second electrode 42 is widened.

Then, as shown in FIGS. 9C and 9D, the moving mechanism 45 moves the second electrode 42 in a direction opposite to the moving direction of the first electrode 41 before the first electrode 41 reaches one end (a left end in the illustrated example) of the heating target region. The first electrode 41 and the second electrode 42 may reach respective ends of the heating target region at the same time. In this way, the region $w_2$ is heated to the extent that the load is not applied to the workpiece w in a subsequent pressing process. By doing so, as shown in FIGS. 9E and 9F, the first electrode 41 and the second electrode 42 are moved by the moving mechanism 44 and the moving mechanism 45, respectively, and reach respective ends of the heating target region of the workpiece w, so that the space between the electrodes is widened.

By the above process, for example, as shown in FIG. 9G, the heating temperature on the left side of the weld bead portion 3 is $T_1$ and the heating temperature on the right side of the weld bead portion 3 is $T_2$ ($<T_1$). Accordingly, the heating target region of the workpiece w is heated such that the heating target region is divided into a high temperature region and a low temperature region. Then, the workpiece w heated in this way is formed into a predetermined shape via pressing.

Herein, in a case where the first electrode 41 is moved to uniformly heat the region $w_1$ so that a state shown in FIGS. 9A and 9B is changed to a state shown in FIGS. 9C and 9D, the moving speed of the first electrode 41 is set as follows. The cross-sectional area ratio $A_n/A_0$ of each segment region is calculated from the shape and dimensions of the region $w_1$. The current applying time $t_n$ for each segment region is calculated so that the temperature rise ratio n is equal to "1" in the formula (8) described above and the current applying time is proportional to the square of the cross-sectional area ratio of each segment region. The moving speed of the first electrode 41 is set depending on the current applying time for each segment region. The moving mechanism 44 moves the first electrode 41 at the set speed. In this way, the region is uniformly heated to the temperature $T_1$ as indicated by the solid line in FIG. 9G.

Further, in a case where the temperature rise distribution is set in the region $w_1$ of the workpiece w, the moving speed of the first electrode 41 is set as follows. The cross-sectional area ratio $A_n/A_0$ of each segment region is calculated from the shape and dimensions of the region $w_1$. The current applying time $t_n$ for each segment region is calculated so that the temperature rise ratio of each segment region to be set using the formula (8) described above is equal to "n" and the current applying time is proportional to the square of the cross-sectional area ratio of each segment region. The moving speed of the first electrode 41 is set depending on the current applying time for each segment region. The moving mechanism 44 moves the first electrode 41 at the set speed. In this way, the region is heated to have the temperature distribution as indicated by the dotted line in FIG. 9G, for example.

In both cases, since the cross-sectional area of the region $w_2$ of the workpiece w is increased along the moving direction of the second electrode, the temperature rise in the right side region including the position of the weld bead portion 3 is decreased as it becomes farther from the weld bead portion 3, as shown in FIG. 9G. Essentially, since the region $w_2$ is not a region to be quenched and therefore a temperature range of a warm working is sufficient for the region $w_2$, it is less necessary to heat the region $w_2$ uniformly.

By doing so, the region $w_1$ is heated to the hot working temperature by direct resistance heating and the region $w_2$ is heated to the warm working temperature by direct resistance heating. In this way, each of the region $w_1$ and the region $w_2$ can be heated to different temperatures by using the pair of electrodes 43 and individually moving the first electrode 41 and the second electrode 42 in the opposite directions on the workpiece w which is fixed.

In the fourth embodiment, from FIGS. 9A and 9B to FIGS. 9C and 9D, the first electrode 41 may be moved to the left end without moving the second electrode 42. In this way, it is also possible to heat only the region $w_1$.

Next, a direct resistance heating method according to a fifth embodiment of the present invention will be described with reference to FIGS. 10A to 10G.

A direct resistance heating apparatus 40 shown in FIGS. 10A to 10F has a similar configuration as the direct resistance heating apparatus 40 shown in FIG. 8A to 8D. Further, like the fourth embodiment shown in FIG. 9A to 9G, one side of the workpiece w is a region $w_1$ to be heated to a hot working temperature, that is, a quenching temperature, and the other side of the workpiece w is a region $w_2$ to be heated to a warm working temperature lower than the quenching temperature. The fifth embodiment is different from the fourth embodiment in that, before the start of the direct resistance heating, the first electrode 41 is arranged on the region $w_1$ and the second electrode 42 is arranged on the region $w_2$. In the fourth embodiment, before the start of direct resistance heating, both the first electrode 41 and the second electrode 42 are arranged on the region $w_1$ and the weld bead portion 3 is not heated to a high temperature but heated to a low temperature. In contrast, in the fifth embodiment, the first electrode 41 and the second electrode 42 are arranged at both sides of the weld bead portion 3 before direct resistance heating, the first electrode 41 is moved to the left side and the other end 41 is moved to one end of the region $w_2$ before the first electrode 41 reaches one end of the region $w_1$. The first electrode 41 and the second electrode 42 may reach respective ends of the heating target region at the same time. By doing so, the weld bead portion 3 is heated to a high temperature. Also in the fifth embodiment, the power feeding unit 1 supplies a constant current between the first electrode 41 and the second electrode 42.

Figures 10A, 10B, 10C, 10D, 10E, 10F, 10G:
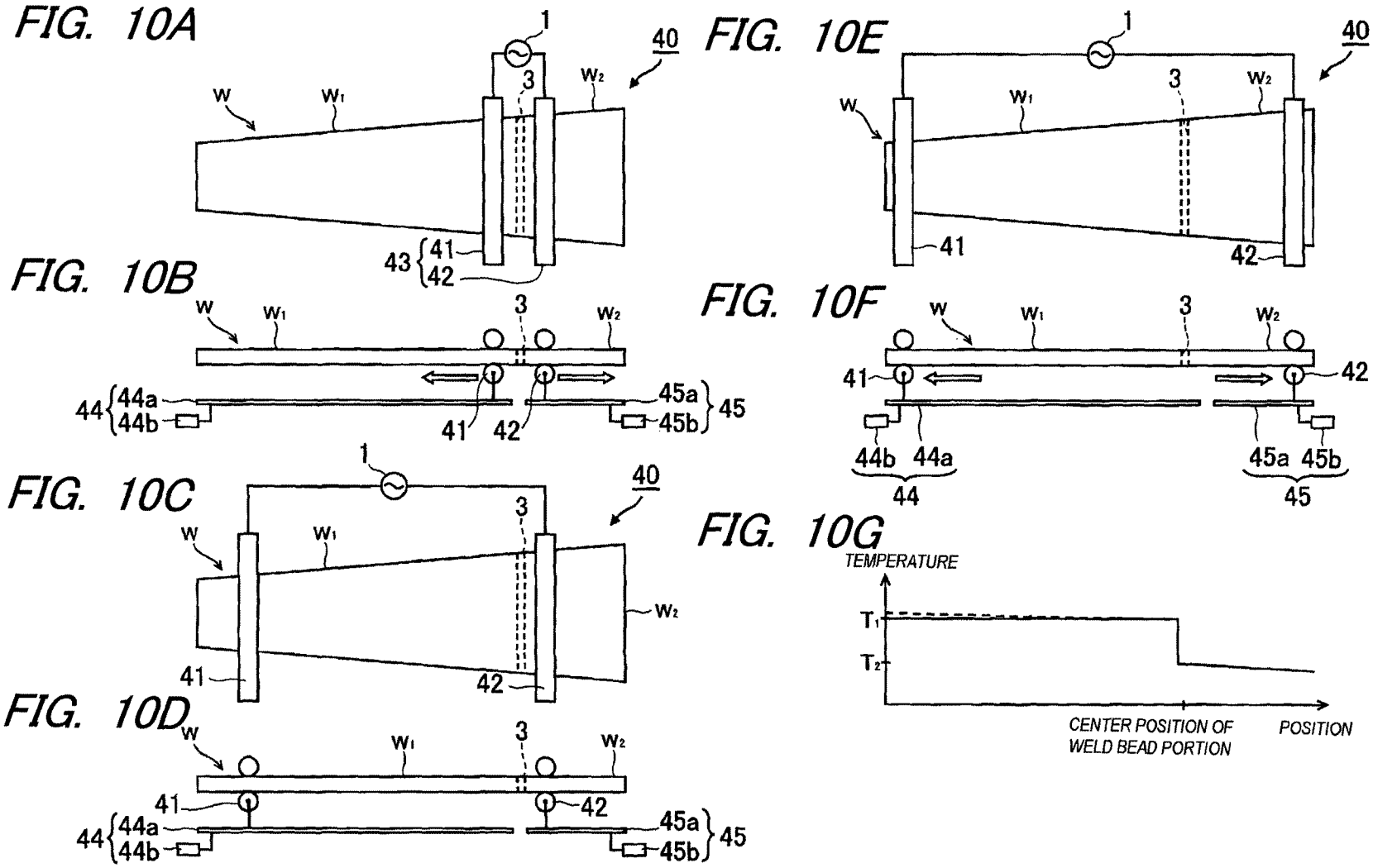

Here, also in the fifth embodiment, by adjusting the moving speed of the first electrode 41, the region $w_1$ may be uniformly heated to the temperature $T_1$ as indicated by the solid line in FIG. 10G or the region $w_2$ may be heated to have a temperature gradient upward to the left as indicated by the dotted line in FIG. 10G. Adjustment of the moving speed of the first electrode 41 is the same as in the fourth embodiment and therefore a description thereof is omitted. Further, in the fifth embodiment, from FIGS. 10A and 10B to FIGS. 10C and 10D, the first electrode 41 may be moved to the left end without moving the second electrode 42. In this way, it is also possible to heat only the region $w_1$.

As in the fourth embodiment and the fifth embodiment, when the workpiece w is a blank having a weld bead portion 3 at which a plurality of plates made of different materials and/or having different thicknesses are joined, it is possible to control whether the weld bead portion 3 and its vicinity are heated to a high temperature or a low temperature, in accordance with a positional relationship among the first electrode 41, the second electrode 42 and the weld bead portion 3.

As in the fourth embodiment, the first electrode 41 and the second electrode 42 are placed on one steel plate such that a space is provided between the first electrode 41 and the second electrode 42, and the electrode that is farther from the weld bead portion 3, that is, the first electrode 41 is moved so as to widen the space between the first electrode and the second electrode 42. Then, both of the electrodes 41, 42 are moved in the opposite directions before the first electrode 41 reaches the end of the one steel plate such that the second electrode 42 is moved across the weld bead portion 3 and reaches the end of the other steel plate. In this case, the weld bead portion 2 is heated only to a low temperature. Further, a region which is not heated to a high temperature remains between one steel plate on the side of the region $w_1$ which is heated to a high temperature and a contact point with the second electrode 42. The region which is not heated to a high temperature corresponds to the portion in the vicinity of the weld bead portion 3 described above.

Meanwhile, as in the fifth embodiment, the first electrode 41 is placed on one steel plate, the second electrode 42 is placed on the other steel plate and the weld bead portion 3 is provided between both electrodes 41, 42. Then, both electrodes 41, 42 are moved in the opposite directions so that the first electrode 41 located on one steel plate on the side of the region $w_1$ which is heated to a high temperature is far away from the second electrode 42 and the second electrode 42 reaches one end of the other steel plate before the first electrode 41 reaches one end of the one steel plate. In this case, the weld bead portion 3 is heated to a high temperature. Further, a region which is heated to a high temperature exists between the other steel plate on the side of the region $w_2$ which is heated to a low temperature and a contact point with the second electrode 42.

Next, a direct resistance heating method according to a sixth embodiment of the present invention will be described with reference to FIGS. 11A to 11I.

Like the fourth embodiment and the fifth embodiment, in the sixth embodiment, the tailored blank is considered as the workpiece w, one side of the workpiece w is a region $w_1$ to be heated to a hot working temperature, that is, a quenching temperature, and the other side of the workpiece w is a region $w_2$ to be heated to a warm working temperature lower than the quenching temperature.

The sixth embodiment is different from the fourth embodiment and the fifth embodiment in that there is a difference between the thickness of one steel plate on the region $w_1$ side and the thickness of the other steel plate on the region $w_2$ side. Although the steel plate on the region $w_2$ side is thicker than the steel plate on the region $w_1$ side in the illustrated example, on the contrary, the steel plate on the region $w_1$ side may be thicker than the steel plate on the region $w_2$ side. The weld bead portion 3 is inclined due to a difference in the thickness of the steel plates and, in some cases, irregularities are caused by welding. In this case, the electric current is not directly applied to the weld bead portion 3. This is because a spark is generated when the electrode slides on the weld bead portion 3 with the electric current being applied to the electrode from the power feeding unit 1. In this case, each of the regions $w_1$, $w_2$ on respective sides of the weld bead portion 3 is heated by direct resistance heating, so that the weld bead portion 3 is heated by heat transfer from each of the regions $w_1$, $w_2$.

Similar to the fourth embodiment and the fifth embodiment, the region $w_1$ on the left is heated to the hot working temperature whereas the region $w_2$ on the right is heated to the warm working temperature, so that these regions can be easily pressed in a subsequent process. The sixth embodiment employs the direct resistance heating apparatus 10 which includes a first electrode as a fixed electrode and the second electrode as a moving electrode, as shown in FIG. 1.

The steps of the direct resistance heating method according to the sixth embodiment are described.

Figures 11A, 11B, 11C, 11D, 11E, 11F, 11G, 11H, 11I:
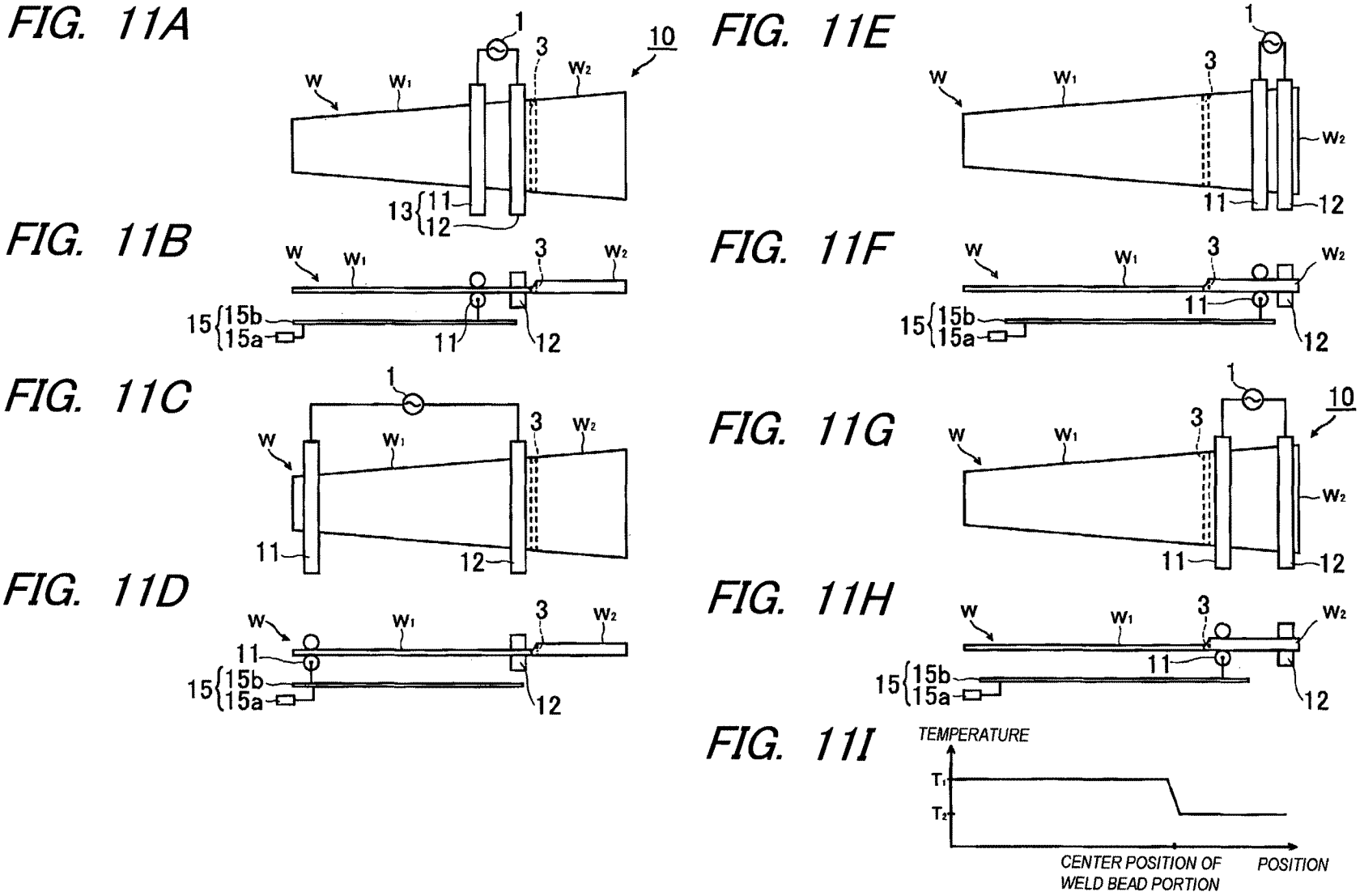

First, as shown in FIGS. 11A and 11B, the fixed other electrode 12 is placed on the right end of the region $w_1$ so as not to interfere with the weld bead portion 3. The moving a first electrode 11 is placed on the region $w_1$ in a state of being spaced apart from the second electrode 12. The reason is that the region $w_1$ of the workpiece w has a larger sectional area on the right side, as shown in FIG. 11A.

Thereafter, in a state in which the second electrode 12 is fixed with a constant electric current $i_1$ being applied between the first electrode 11 and the second electrode 12, the moving mechanism 15 moves the first electrode 11 away from the second electrode 12 and therefore the space between the first electrode 11 and the second electrode 12 is widened. As shown in FIGS. 11C and 11D, the current is stopped from being applied when the first electrode 11 reaches the other end of the region $w_1$.

Then, as shown in FIGS. 11E and 11F, the workpiece w is shifted to the left direction and the first electrode 11 and the second electrode 12 are placed in a predetermined position of the region $w_2$. That is, the fixed other electrode 12 is placed on the right end of the region $w_2$ and the moving a first electrode 11 is placed on the region $w_2$ in a state of being spaced apart from the second electrode 12. The reason is that the region $w_2$ of the workpiece w has a larger sectional area on the right side, as shown in FIG. 11E.

Thereafter, in a state in which the second electrode 12 is fixed with a constant electric current $i_2$ ($<i_1$) being applied between the first electrode 11 and the second electrode 12, the moving mechanism 15 moves the first electrode 11 away from the second electrode 12 and therefore the space between the first electrode 11 and the second electrode 12 is widened. As shown in FIGS. 11G and 11H, the current is stopped from being applied when the first electrode 11 reaches the other end of the region $w_2$. At that time, the first electrode 11 is not in contact with the weld bead portion 3.

By the above process, for example, as shown in FIG. 11I, the heating temperature on the left side of the weld bead portion 3 is $T_1$ and the heating temperature on the right position of the weld bead portion 3 is $T_2$ ($<T_1$). Accordingly, the heating target region of the workpiece w is heated such that the heating target region is divided into a high temperature region and a low temperature region. In the sixth embodiment, the electric current is not directly applied to the weld bead portion 3. However, since the region $w_1$ and the region $w_2$ are heated by direct resistance heating, the weld bead portion 3 is heated by heat transfer from both sides thereof. Then, the workpiece w heated in this way is formed into a predetermined shape via pressing.

As shown in FIG. 11I, the temperature distribution in each of the regions $w_1$, $w_2$ is substantially uniform for each of the regions $w_1$, $w_2$. This is because the moving speed is respectively calculated from the dimensions of the regions $w_1$, $w_2$, as described above, such that the first electrode 11 is moved by the adjusting unit 15*a* to uniformly heat the regions $w_1$, $w_2$.

While several embodiments of the present invention have been described above, some aspects thereof will be described below.

When the resistance per unit length along a electrode moving direction in the heating target region of the workpiece monotonically increases, for example, in a case in which the width of the heating target region is decreased along the moving electrode direction, the temperature of the heating target region can be increased evenly to create a temperature rise distribution in the heating target region of the workpiece by controlling the speed of the moving electrode in accordance with the decrease.

When the workpiece is a blank having a weld bead portion (a welded portion) at which a plurality of steel plates made of different materials and/or having different thicknesses are joined, the moving electrode may be moved without moving across the weld bead portion. In this case, there is a need to perform direct resistance heating for each steel material. However, since the width of the weld bead portion is relatively narrow, thermal energy can be supplied to the weld bead portion by heat transfer from both sides thereof when each steel material is individually heated and therefore there is no problem. By doing so, it is possible to reduce the influence of the current density of the weld bead portion which is different for each location.

Even when the workpiece is a blank having a weld bead portion at which a plurality of steel plates made of different materials and/or having different thicknesses are joined, the moving electrode may be moved across the weld bead portion during current supply when the difference in thickness of the respective steel plates is small. In this case, different steel plates can be heated by direct resistance heating in a single process and therefore it is possible to shorten the direct resistance heating process.

In the present invention, since the amount of heat applied to the divided region can be controlled along the moving direction of the electrode when the heating target region of the workpiece is divided into strips along the moving direction of the electrode, the workpiece can be heated in a predetermined temperature distribution. When carrying out a direct resistance heating so that the heating target region of the workpiece has a predetermined temperature distribution, for example, so that the heating target region has a temperature distribution which has a substantially constant cross-sectional area and is shifted from the high temperature to the low temperature in one direction, the amount of electricity of the regions which are divided into strips toward the moving direction can be varied for each region by moving at least a first electrode in the one direction, so that a predetermined temperature distribution can be achieved.

Although respective embodiments have been described above, the present invention may be appropriately changed and practiced depending on the shape and dimensions of the workpiece w. The workpiece w is not limited to the shape shown and the thickness thereof may be uneven, for example. Further, longitudinal sides of the workpiece w connecting the left and right sides of the workpiece w side may be curved instead of being straight or the longitudinal sides of the workpiece w may be configured by connecting a plurality of straight lines or curved lines with different curvatures.

Further, in the above description, an example in which the entire workpiece w is the heating target region, an example in which a portion of the workpiece w is the heating target region, and an example in which the workpiece w is divided into a plurality of heating target regions have been described. Besides these examples, the workpiece w may be divided into a plurality of heating target regions in a direction intersecting the moving direction of the moving electrode, that is, one of the first electrode and the second electrode to be placed on the workpiece w with a space provided between the first electrode and the second electrode. In other words, the workpiece w may be divided into a plurality of heating target regions in the width direction of the workpiece w, not in the longitudinal direction, and the moving electrode may be provided for each heating target region. In this case, the heating target regions may be adjacent to each other in the width direction or may be separated from each other in the width direction.

As described above, depending the shape and size of the workpiece w and depending on the heating target region of the workpiece w, one or more moving electrodes may be provided to heat the workpiece by direct resistance heating, and a fixed electrode may be provided optionally if needed.

INDUSTRIAL APPLICABILITY

One or more embodiments of the invention provide a direct resistance heating method which makes it less necessary to provide a plurality of pairs of electrodes to heat a workpiece.

This application is based on Japanese Patent Application No. 2012-174464 filed on Aug. 6, 2012, the entire content of which is incorporated herein by reference.

The invention claimed is:

1. A direct resistance heating method comprising:

placing a first electrode and a second electrode such that a space is provided between the first electrode and the second electrode and such that each of the first electrode and the second electrode extends across a heating target region of a workpiece; and moving at least one of the first electrode and the second electrode with an electric current being applied between the first electrode and the second electrode and with the first electrode and the second electrode contacting the workpiece, wherein said moving comprises adjusting a period of time during which the electric current is applied for each segment region of the heating target region by adjusting a moving speed of the at least one of the first electrode and the second electrode, wherein the segment regions are defined by dividing the heating target region and are arranged side by side along a direction in which the at least one of the first electrode and the second electrode is moved, and wherein the at least one of the first electrode and the second electrode is moved in the direction along which a resistance per unit length of the workpiece increases, and the moving speed of the at least one of the first electrode and the second electrode is adjusted in accordance with the increase of the resistance.

2. The direct resistance heating method according to claim 1, wherein the workpiece is a blank having a welded portion at which a first steel plate and a second steel plate are joined, at least one of materials forming the first steel plate and the second steel plate and thicknesses of the first steel plate and the second steel plate being different from each other, wherein the first electrode and the second electrode are placed on the first steel plate such that the first electrode is farther from the welded portion than the second electrode, and wherein the first electrode is moved so as not to move across the welded portion, with the electric current being applied between the first electrode and the second electrode.

3. The direct resistance heating method according to claim 2, wherein, before the first electrode reaches an end of the first steel plate, the second electrode is moved across the welded portion to reach an end of the second steel plate.

4. The direct resistance heating method according to claim 1, wherein the workpiece is a blank having a welded portion at which a first steel plate and a second steel plate are joined, at least one of materials forming the first steel plate and the second steel plate and thicknesses of the first steel plate and the second steel plate being different from each other, wherein the first electrode is placed on the first steel plate and the second electrode is placed on the second steel plate such that the welded portion is disposed between the first electrode and the second electrode, and wherein the first electrode is moved away from the welded portion and the second electrode, with the electric current being applied between the first electrode and the second electrode.

5. The direct resistance heating method according to claim 4, wherein, before the first electrode reaches an end of the first steel plate, the second electrode is moved away from the welded portion and the first electrode.

6. A direct resistance heating method comprising:

placing a first electrode and a second electrode such that a space is provided between the first electrode and the second electrode and such that each of the first electrode and the second electrode extends across a heating target region of a workpiece; and moving at least one of the first electrode and the second electrode with an electric current being applied between the first electrode and the second electrode and with the first electrode and the second electrode contacting the workpiece, wherein said moving comprises adjusting a period of time during which the electric current is applied for each segment region of the heating target region, wherein the segment regions are defined by dividing the heating target region and are arranged side by side along a direction in which the at least one of the first electrode and the second electrode is moved, wherein, with the electric current applied between the first electrode and the second electrode being constant, the first electrode is moved without moving the second electrode to widen the space between the first electrode and the second electrode, and the second electrode subsequently is moved in a direction opposite to the direction in which the first electrode is moved, thereby heating the heating target region such that the heating target region is divided into a high temperature region and a low temperature region.

7. The direct resistance heating method according to claim 6, wherein the second electrode is moved before the first electrode reaches an end of the heating target region.

8. The direct resistance heating method according to claim 1, wherein the electric current is a constant electric current.

9. The direct resistance heating method according to claim 2, wherein the electric current is a constant electric current.

10. The direct resistance heating method according to claim 4, wherein the electric current is a constant electric current.

* * * * *